United States Patent [19]

Hergert et al.

[11] 4,298,429

[45] Nov. 3, 1981

[54] MEANS FOR EFFECTING CROSS DIRECTION FIBER ORIENTATION IN A PAPERMAKING MACHINE HEADBOX

[75] Inventors: Richard E. Hergert, Rockton, Ill.; Jan I. Bergstrom, Beloit, Wis.

[73] Assignee: Beloit Corporation, Beloit, Wis.

[21] Appl. No.: 76,410

[22] Filed: Sep. 17, 1979

[51] Int. Cl.[3] ..... D21F 1/02; D21F 1/06

[52] U.S. Cl. ..... 162/343; 162/344; 162/347

[58] Field of Search ..... 162/212, 216, 202, 336, 162/343, 344, 347

[56] References Cited

U.S. PATENT DOCUMENTS

| | | | |
|---|---|---|---|
| 3,791,918 | 2/1974 | Koskimies et al. | 162/343 |
| 3,846,229 | 11/1974 | Kallmes | 162/216 |
| 3,853,697 | 12/1974 | Parker | 162/343 |
| 4,070,238 | 1/1978 | Wahren | 162/343 |
| 4,133,715 | 1/1979 | Hergert | 162/341 |

*Primary Examiner*—Peter Chin

*Attorney, Agent, or Firm*—Hill, Van Santen, Steadman, Chiara & Simpson

[57] ABSTRACT

At least a substantial proportion of the fibers in papermaking stock are delivered in cross direction orientation to the slice chamber of a headbox and remain in the cross direction orientation for delivery from the slice chamber to a forming surface. The cross direction orientation is effected by a set of partitions defining stock flow passages extending obliquely in the cross direction, receiving the stock flowing in the machine direction and biasing the streams of the stock to flow in generally the cross direction to the downstream ends of the passages from which the streams are diverted in substantially the machine direction towards the slice chamber. The stock with fibers oriented in the cross direction may be supplied to turbulence controlling channels in the slice chamber.

11 Claims, 4 Drawing Figures

MEANS FOR EFFECTING CROSS DIRECTION FIBER ORIENTATION IN A PAPERMAKING MACHINE HEADBOX

This invention relates to a new and improved means for effecting cross direction fiber orientation in a papermaking machine headbox, and is more particularly concerned with improving the cross direction tensile strength ratio in paper webs.

Much attention has been given to attaining fine dispersion in the paper stock delivered from the headbox of a papermaking machine to the forming surface in order to avoid flocculation. For example, floating dividers in the slice chamber of the headbox for attaining such result are disclosed in U.S. Pat. Nos. 3,853,697 and 4,133,715. Other examples are found in U.S. Pat. No. 3,791,918 which provides a headbox in which the interior is divided by vanes into a plurality of flow channels, the vanes being inclined to a vertical plane and spaced apart so that the height of each flow channel is substantially greater than its width. In U.S. Pat. No. 3,846,229, micro-turbulence generator means are provided having tubes of quadrangular cross section with partition vane members extending from wall-to-wall transverse to the tube axis and dividing the interior of the tube into two parallel mutually isolated flow paths having the same cross sectional area so that there is flow in cross sectional shape alternately between quadrangular and triangular without substantially changing the cross sectional area so as to produce fine-scale turbulence in the stock flowing in each path, the stock from all of the paths being discharged into a common slice nozzle.

U.S. Pat. No. 4,070,238 provides a headbox having a rectifier stage, a fine mixing stage downstream relative to the direction of stock flow from the rectifier stage with the fine mixing stage including closely spaced planar lamelae disposed substantially parallel to the medial axis in the flow direction of the fine mixing stage and oblique to a medial transverse plane of the fine mixing stage, that is a plane defined by the medial axis which extends in the machine direction, and by a medial line perpendicular to the axis. The stock delivery nozzle communicates with a mixing section downstream from the fine-mixing stage and defined by opposed converging walls terminating in a slice opening. While there is mixing agitation of the stock in the mixing stage, there is no cross machine biasing of the fibers in the flowing stock, but the direction of flow of the stock is consistently in the machine direction.

In the various patented examples alluded to, even though fine or micro dispersion and turbulence control may be attained, fiber orientation at the slice jet remains predominantly in the machine direction, that is the direction of stock flow. Therefore, the machine direction tensile strength is generally greater than the cross direction tensile strength. This is especially experienced with low ratio tissue. It is to the alleviation of this tensile strength disparity problem that the present invention is directed.

It is, therefore, an important object of the present invention to provide a new and improved method of and means for effecting cross direction fiber orientation in a papermaking machine headbox and thereby improving the cross direction strength ratio in paper webs formed by delivery of stock from the headbox to a forming surface in a papermaking machine.

Another object of the invention is to provide a new and improved simple, efficient and reliable method of and means for effecting cross direction fiber orientation in papermaking machine headboxes. In a paper making machine headbox adapted for effecting cross machine direction fiber orientation in paper making stock flowing through the headbox, and including a slice chamber through which the stock flows in machine direction from a receiving end to a slice adapted to be associated with paper forming means, and stock delivering chamber means having an upstream end adapted to communicate with a stock supply and a downstream end communicating with said receiving end of said slice chamber, a set of spaced partitions which extend in oblique cross machine planes for defining passages dividing the paper making stock into a plurality of streams intermediate said upstream and downstream ends of said delivering chamber means for biasing the direction of flow of the flowing paper making stock in cross machine direction for orienting stock fibers in the cross machine direction; flanges at the downstream ends of said partitions for diverting the paper making stock from the downstream ends of said passages into substantially the machine direction to said receiving end of said slice chamber while permitting at least a substantial proportion of fibers to remain in the cross machine direction orientation, so that at least a substantial proportion of the fibers will remain in the cross machine orientation during stock flow in said slice chamber to said slice and the cross machine oriented fibers will provide cross direction tensile strength in paper formed from said stock.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 1:
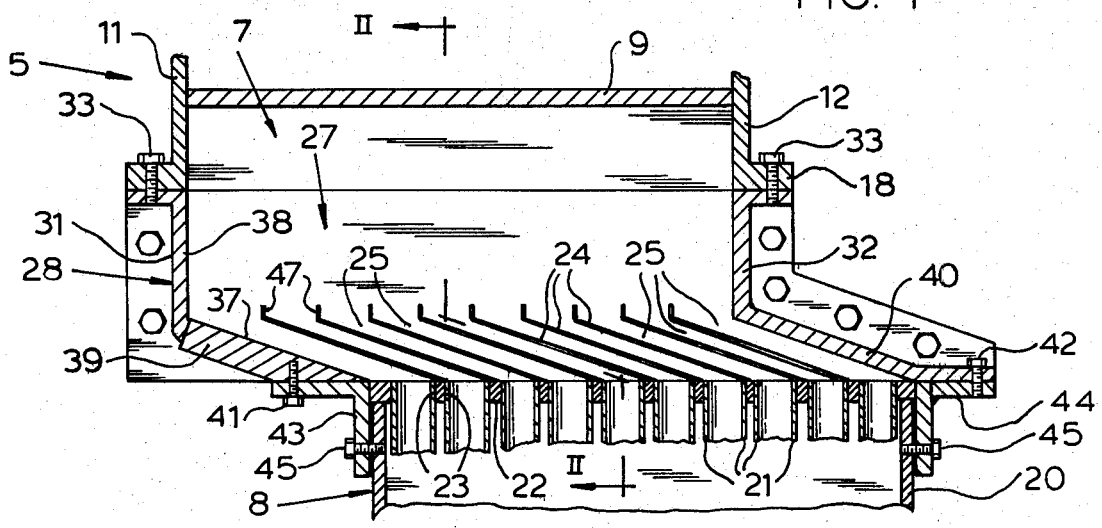
FIG. 1 is a fragmentary vertical transverse sectional detail view of a headbox embodying the invention, and taken substantially along the line I—I of FIG. 2.
Figure 2:
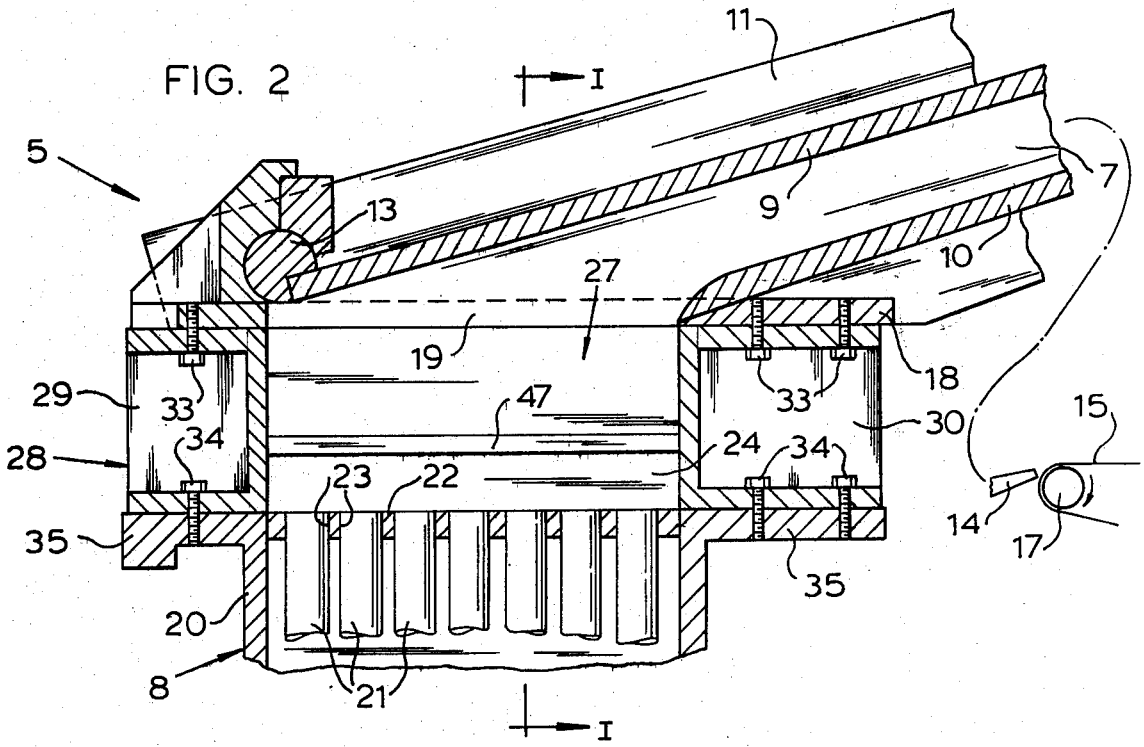
FIG. 2 is a longitudinal sectional detail view taken substantially along the line II—II of FIG. 1, and in part schematic.

On reference to FIGS. 1 and 2, a headbox 5 is depicted, which may as to many of its details be similar to the headbox disclosed in the aforesaid U.S. Pat. No. 4,133,715, and to the extent necessary the disclosure of that patent is incorporated herein by reference. To the extent shown herein, the headbox 5 includes a slice chamber 7 and chamber means 8 for delivering papermaking stock to the slice chamber. In a preferred arrangement, the slice chamber 7 is defined by an upper wall or roof 9, a lower wall or floor 10 and pond sides 11 and 12. Whereas the floor 10 may be fixedly secured to the pond sides 11 and 12, as by means of welding or like, the roof 9 is desirably pivotally mounted as by means of a pivot 13 to and between the pond sides 11 and 12, so as to permit adjustment of a slice 14 defined between the downstream ends of the roof and floor which converge for this purpose toward a forming surface means, such as a fourdrinier wire 15 trained about a forming roll 17 and operating in the usual manner to receive fibrous papermaking stock delivered thereto as a jet stream issuing from the slice 14.

At their rear or upstream ends, the roof 9 and the floor 10 are located adjacent to base structure 18 and define with the adjacent portions of the pond sides 11 and 12, a receiving opening 19 through which fibrous papermaking stock is delivered from the delivering means 8 to flow in machine direction along the longitudinal axis of the slice chamber 7 to the slice 14.

As shown, the delivering means 8 includes a box portion 20 which is in stock flow communication with the opening 19 and has a bank of stock tubes 21 extending in the machine direction and having their ends nearest the opening 19 secured to a perforated supporting plate 22 provided for this purpose with respective ports 23. In this instance, the arrangement is such that the slice chamber 7 has its axis extending at an acute angle relative to the plane of the plate 22 and correspondingly angular to the axes of the stock tubes 21. Stock is supplied to the upstream ends of the tubes 21 from a suitable supply source (not shown).

Means for biasing the stock flow in generally cross machine direction (i.e. transversely relative to the machine direction) in travel from the upstream end to the downstream end of the delivering chamber means 8 for effecting substantial cross machine direction orientation of stock fibers passing from the delivering means 8 to the slice chamber 7 comprises a set of partitions 24 defining stock flow passages 25 extending obliquely in the cross machine direction, as best seen in FIG. 1. The partitions 24 comprise relatively thin plates mounted within a subchamber 27 located between and communicating with the downstream end of the headbox portion 20 and the upstream end receiving opening 19 of the slice chamber 7. In a desirable construction, the chamber 27 is defined within a housing assembly 28 constructed and arranged as an insert unit between the stock supplying portion 8 of the headbox and the slice chamber portion of the headbox. The insert assembly 28 comprises opposite end spacers 29 and 30 and opposite side spacers 31 and 32, which may be formed up by welding and are welded together to enclose the chamber 27. Means for attaching the spacers 29 to 32 to the base structure 18 separably may comprise bolts 33. Separable attachment of the spacers to the headbox portion 20 may comprise bolts 34 which secure the assembly 28 to lateral flange means 35 on the headbox portion 20.

In cooperation with the obliquely disposed partitions 24, the subchamber 27 is formed to provide a generally oblique offsetting portion 37 complementary to the oblique disposition of the partitions 24 and extending obliquely from the plate 22 to a portion 38 of the subchamber 27 which has its axis aligned in machine direction and communicates with the receiving opening 19 to the slice chamber 7. It will be observed that in this relationship the flow passages 25 extend obliquely relative to the axis of the chamber portion 38, and may also extend obliquely relative to the axis of the headbox portion 20.

Offsetting spaced parallel diagonal opposite side walls 39 and 40 defining the diagonally extending offsetting chamber portion are attached as by means of bolts 41 and 42, respectively, to angle brackets 43 and 44, respectively, to which the perforated plate 22 is desirably secured as by means of welding. The brackets 43 and 44 are secured as by means of bolts 45 to the headbox portion 20. Thereby the brackets 43 and 44 serve the dual function of retaining the plate 22 in place and also retaining and supporting the walls 39 and 40.

Significant improvement in cross direction tensile strength ratio has been attained at a machine speed of 4,000 feet per minute producing tissue having a basis weight of 10 pounds per 3,000 square feet and wherein the bank of tubes 21 has been, as shown herein, in rows having 10 tubes in the cross direction and 7 tubes in rows at right angles to the 10 tube rows and with the partitions 24 and the passages 25 extending at oblique angle of about 18° to the respective axes of the adjacent tubes 21. At their upstream ends, the partitions 24 are located at the discharge face of the plate 22 medially between the 7 tube rows, whereby all of the stock from each of the 7 tube rows discharges into one of the respective passages 25. At each side in the cross direction, the wall 39 and the wall 40, respectively, cooperate with the nearest adjacent partition 24 to define one of the passages 25. The arrangement is such that at least the passages 25 between confronting partitions 24 may be of a width between partitions about $\frac{1}{3}$ of the tube passage diameters. For example, where the tube passage diameters are about $1\frac{1}{4}$ inch, the between partition width of the passages 25 may be about 7/16 inch. Since the tubes 21 are as close together as practicable, it will be apparent that the total cross sectional flow area of each 7-tube row is somewhat greater than the cross sectional flow area of the aligned passage 25. As a result, there is a venturi effect in the passages 25 which will effectively tend to orient the fibers in the stock streams in the passages in generally the cross direction of the passages 25, although the stock flows from the tubes 21 in the machine direction toward and into the upstream ends of the passages 25.

After only a relatively short cross machine diversion of the fibrous paper stock in the passages 25, the streams are diverted in substantially the machine direction into the slice chamber 7. More particularly, the streams of stock from the passages 25 are directed into the machine direction chamber portion 38. This is effected with a pressure drop as the stock streams from the passages 25 enter the chamber portion 38, whereby although the stock from all of the passages 25 now joins a common stream traveling to and through the slice chamber 7, at least a substantial proportion of the stock fibers are permitted to remain in the cross direction orientation for delivery from the slice chamber 7 to the forming surface 15.

For efficiently effecting the machine direction diversion from the passages 25, the downstream ends of the partitions 24 are provided with means comprising short diversion flanges 47 entirely therealong and all extending in the machine direction, preferably parallel to the axes of the tubes 21. In the arrangement as described, the partitions 24 may be about 6 inches long and the flanges 47 about $\frac{1}{2}$ inch long. At the opposite sides, the flanges 47 cooperate with the walls 31 and 32 as part of the diverting means. It will be observed that by virtue of the relatively staggered location of the downstream ends of the partitions 24 relative to one another, the space between the flanges 47 and between the end flanges 47 and the walls 31 and 32 is substantially wider than the aligned passages 25, whereby to implement the pressure drop at the downstream ends of the passages 25. Considered in one way, the passages 25 have controlled pressure drop expansion areas at their downstream ends defined by the flanges 47, and the adjacent parts of the walls 31 and 32.

Figure 3:
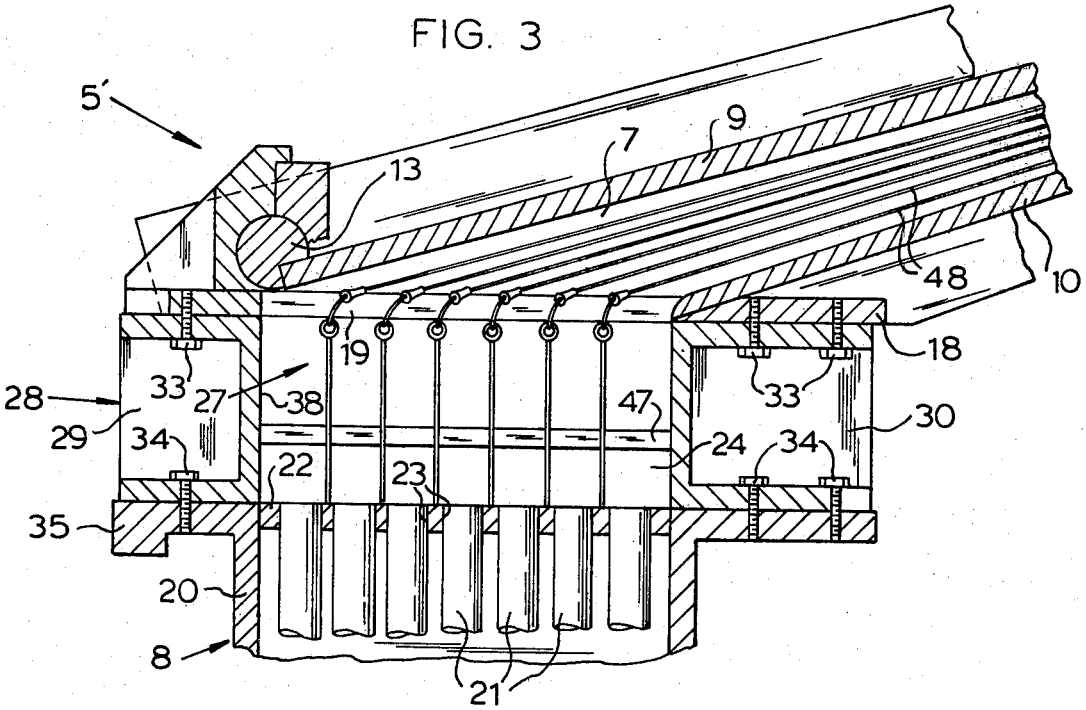
FIG. 3 is a view similar to FIG. 2 but showing a modification.
Figure 4:
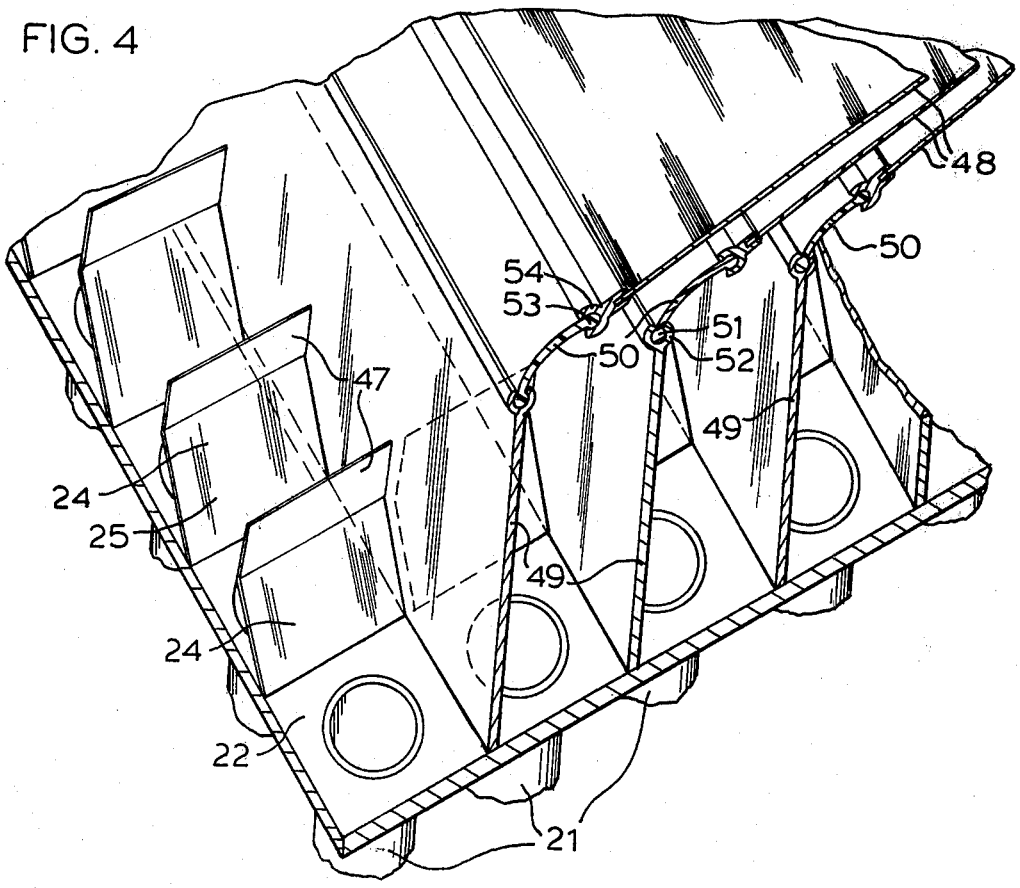
FIG. 4 is a fragmentary enlarged perspective detail view of the FIG. 3 modification.

In the modification of FIGS. 3 and 4, provision is made for the dispersion of fibers to avoid flocculation in heavier grades of paper, and where desired, not only fine dispersion, but also multi-stock paper formation, in addition to cross direction orientation of fibers. To this end, the headbox 5′ may be constructed substantially the same as the headbox 5 except that floating slice chamber dividers 48 are provided in the slice chamber 7 similarly as in the disclosures of U.S. Pat. Nos. 3,853,697 and 4,133,715, but with modification of the mountings for the dividers consistent with the cross direction fiber orientation attained by the present invention. To this end, details of structure of the headbox 5′ are the same as for the headbox 5 where identified by the same reference characters. In addition, however, within the insert assembly 28, the subchamber 27 is subdivided by fixed dividers 49 extending in spaced parallel relation and normal to and across the planes of the partitions 24 and the passages 25. The dividers 49 have edges in engagement with the plate 22 and the sidewalls defining the subchamber 27 with free edges of the dividers 49 located adjacent to the entrance 19 into the slice chamber 7 and providing means for mounting the upstream or mounted ends of the floating slice chamber dividers 48. Where, as shown, it is desired to have the slice chamber 7 divided into 5 channels, 5 of the dividers 49 are provided. In this instance, each of the dividers 49 is connected to the plate 22 between each of the 10 tube rows of the tubes 21. If less channels are desired, less of the dividers 49 may be used with the same number of the tubes 21 or with a smaller number, depending on particular circumstances. In any event, the dividers 49 divide the passages 25 into, in effect, extensions of the channels defined by the dividers 48 in the slice chamber 7. The arrangement combines a plurality of the streams in the passages 25 within each of the channels defined by the floating dividers 48.

If it is desired to have selected types of stock in the respective channels, all of the tubes 21 aligned with those channels will be supplied with the same stock, and which stock may differ from the stock supplied by other tubes aligned with other of the channels. The different stock furnishes are kept separated by the floating dividers 48, until joined in layers in the slice jet. For example, where it is desired to have the outer or face layers of the end product sheet of a different stock from the inner layers, the two outermost channels will receive stock from the tubes 21 at the opposite cross direction sides of the headbox. The furnish for the inner layers may differ in any desired characteristics relative to the face layers and to one another. Of course, where the end product is to be formed from the same stock throughout, no division of stock input need be made. By virtue of the cross direction bias of stock flow in the passages 25 leading to the respective slice chamber channels, desirable cross direction orientation of fibers will result in the end product in the several layers produced by the channel separation.

Anchoring of the upstream ends of the floating dividers 48 to the fixed dividers 49 may be effected, as shown, by means of holders 50 on the order of those disclosed in U.S. Pat. No. 4,133,715. For this purpose, each of the holders 50 is provided with a base bead-like enlargement 51 along its edge connected in pivotal knuckle arrangement within a channel shaped socket 52 along the edge of the divider 49 to which attached. Along their opposite edges, the holders have the upstream edges of the floating dividers 48 anchored thereto by means of similar knuckle connection comprising, in this instance, a bead-like knuckle enlargement 53 on the edge of each of the holders 50 received in a complementary channel-like socket 54 along the edge of the attached floating dividers. If desired, of course, the knuckle enlargement and socket arrangement may be reversed, so that the socket is on the holder and the knuckle enlargement on the end of the attached floating divider 48. By virtue of the excellent control over turbulence in the slice chamber 7 and therefore at the slice, attained by the floating dividers 48, substantial assurance is had that the cross direction orientation of fibers in the subchamber 27 will persist in whatever paper stock furnish is supplied even in the high speed machine operation.

It will be understood that variations and modifications may be effected without departing from the spirit and scope of the novel concepts of this invention.

We claim as our Invention:

1. In a paper making machine headbox adapted for effecting cross machine direction fiber orientation in paper making stock flowing through the headbox, and including a slice chamber through which the stock flows in machine direction from a receiving end to a slice adapted to be associated with paper forming means, and stock delivering chamber means having an upsteam end adapted to communicate with a stock supply and a downstream end communicating with said receiving end of said slice chamber, a set of spaced partitions which extend in oblique cross machine planes for defining passages dividing the paper making stock into a plurality of streams intermediate said upstream and downstream ends of said delivering chamber means for biasing the direction of flow of the flowing paper making stock in cross machine direction for orienting stock fibers in the cross machine direction;

and flanges at the downstream ends of said partitions extending in substantially the machine direction for diverting the paper making stock from the downstream ends of said passages into substantially the machine direction to said receiving end of said slice chamber while permitting at least a substantial proportion of the fibers to remain in the cross machine direction orientation, so that at least a substantial proportion of the fibers will remain in the cross machine orientation during stock flow in said chamber to said slice and the cross machine oriented fibers will provide cross direction tensile strength in paper formed from said stock.

2. A headbox according to claim 1, wherein said partitions are sufficiently closely spaced for causing velocity acceleration of the flowing paper making stock.

3. A headbox according to claim 1, including floating channel turbulence promoting dividers within said slice chamber and leading from said receiving end to said slice, and means for directing the flowing paper making stock from said passages selectively to channels between the dividers.

4. A headbox according to claim 1, wherein the spacing between the partitions defines the passages with a cross-sectional flow area related to the volume and velocity of the paper making stock supplied to the upstream ends of said passages for causing velocity acceleration of the flowing stock streams in said passages.

5. A headbox according to claim 1, comprising a chamber portion located on an axis substantially aligned with said receiving end of said slice chamber for effecting communication between the downstream ends of said passages and said slice chamber.

6. A headbox according to claim 1, wherein said flanges being spaced apart greater than the flow passage space between said partitions, whereby stock flowing from the downstream ends of said passages experiences a pressure drop which facilitates said permitting at least a substantial proportion of the fibers to remain in said cross machine direction orientation.

7. In a headbox according to claim 1, floating channel dividers within said chamber providing turbulence control channels in the slice chamber leading to the forming surface, and means for directing the streams from said downstream ends of said passages into said channels.

8. In a headbox according to claim 7, said directing means being oriented relative to said passages for combining a plurality of said streams within each of said channels.

9. In a headbox according to claim 1, a plurality of stock tubes supplying the stock to the downstream end of each of said passages.

10. A headbox according to claim 1, wherein said delivering chamber means comprises a insert subchamber assembly between said upstream end of said delivering chamber means and said slice chamber, and said insert assembly is defined in part by a downstream chamber portion aligned with said slice chamber receiving end and defined in part by diagonally extending walls for effecting paper stock supply communication between said upstream end of said delivery chamber means and said downstream portion and within which said partitions are mounted to extend in the same diagonal direction as said diagonally extending walls.

11. A headbox according to claim 10, wherein certain of said partitions and flanges cooperate in spaced relation with the walls defining said insert.

* * * * *